US006598449B2

(12) United States Patent
Müller et al.

(10) Patent No.: US 6,598,449 B2
(45) Date of Patent: Jul. 29, 2003

(54) CONTINUOUS LIGHT SECTION OR WIRE ROD ROLLING TRAIN

(75) Inventors: Hubert Müller, Grevenbroich (DE); Michael Kruse, Düsseldorf (DE); Alfred Müller, Krefeld (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 10/062,298

(22) Filed: Feb. 1, 2002

(65) Prior Publication Data

US 2002/0104357 A1 Aug. 8, 2002

(30) Foreign Application Priority Data

Feb. 2, 2001 (DE) ..... 101 05 213
Sep. 20, 2001 (DE) ..... 101 46 431

(51) Int. Cl.[7] ..... B21B 41/04
(52) U.S. Cl. ..... 72/228; 72/201; 72/230
(58) Field of Search ..... 72/201, 228, 227, 72/230

(56) References Cited

U.S. PATENT DOCUMENTS 1,932,750 A * 10/1933 Rendleman ..... 72/228
6,105,412 A * 8/2000 Muller ..... 72/201
6,119,499 A 9/2000 Muller
6,216,515 B1 * 4/2001 Grimmel et al. ..... 72/228

FOREIGN PATENT DOCUMENTS

| | | |
|---|---|---|
| DE | 198 43 032 | 3/2000 |
| EP | 0 606 966 | 7/1994 |
| EP | 0 606 966 | 9/1997 |

* cited by examiner

*Primary Examiner*—Allen Ostrager
*Assistant Examiner*—John S Goetz
(74) *Attorney, Agent, or Firm*—Herbert Dubno

(57) ABSTRACT

Between an intermediate roll unit and a dimensioning finishing roll unit of a continuous light-section or wire rod rolling train, a multifunctional section is provided with three parallel lines and at least the first and second rolling lines having rolling blocks and substantially all of the lines including cooling sections and/or temperature equalization sections. Via distributing guides and 180° loop forming path segments, the workpieces are selectively directable from the first line to the dimensioning finishing rolling unit without traveling over the second and third lines and to the dimensioning finishing rolling unit after travelling over all or part of the second and third lines.

14 Claims, 3 Drawing Sheets

CONTINUOUS LIGHT SECTION OR WIRE ROD ROLLING TRAIN

FIELD OF THE INVENTION

Our present invention relates to a continuous light-section or wire rod rolling train of the type which comprises between an intermediate rolling block or section and a dimensioning finishing block or section a variable path for the rolled product, i.e. the workpieces.

BACKGROUND OF THE INVENTION

Continuous light-section or wire rod mills in which a variable path is provided between at least one intermediate rolling unit and the dimensioning finishing rolling unit which is followed by a cooling section and/or a temperature equalization section are known and allow better temperature control of the rolling operations and hence improvement of the mechanical properties of the rolled product. Indeed, special thermal treatments can be avoided and controlled temperature profiles can be ensured within the rolling lines.

In thermomechanical rolling, speeds in the finishing mills or stands and like requirements of the rolling line have generally resulted in a close proximity of the rolling stands, a need for heating the product to be rolled and high requirements for temperature control and heat dissipation before the wire rod or small structural shapes produced in the rolling operation reach the finishing rolls.

In the commonly owned U.S. Pat. No. 6,105,412 (DE 198 43 032) for a rolling mill for the continuous rolling of light-sections or wire rod, two paths are provided selectively for the rolled product between the intermediate rolling section and the dimensional finished rolling unit. In a first of these paths the workpieces are fed from the intermediate rolling stand to a finishing mill unit and a sizing mill unit located one behind the other and then to cooling sections before reaching a rolling stack collector. Upstream of the finishing and dimensioning mills, a branch or distributing guide and a cooling section are provided. The second path from this distributing guide also includes a cooling section, a finishing mill unit and a further cooling section with a loop forming a path segment between them and between the second path and a distributing guide leading the rolled product back to the first path upstream of the shear and the finishing and dimensioning mills thereof.

With this mill train, the possibility of varying the paths, the cooling and temperature equalization effects on the rolled product can satisfy some of the different requirements for rolling larger and smaller cross sections.

Another system is disclosed in EP 0 606 966 B1 in which the rolled product coming from the intermediate rolling bock can pass selectively over a branch guide to a line having cooling stretches and a finishing mill block or via further branching guides into a second line parallel to the first and equipped with a finishing mill block and cooling sections and then directly to the rolled product collector or via a distributing guide arrangement between the two lines back to the first.

OBJECTS OF THE INVENTION

It is the principal object of the present invention to improve upon the rolling mill systems described so that the working of the product to be rolled, together with the cooling and temperature equalization can be matched to the material characteristics over a substantially greater range and to enable a substantially greater variation in the products which can be rolled.

Another object of this invention is to provide a continuous light-section or wire rod rolling train of greater versatility, better process control and more effective temperature profile control for a wider variety of rolled products than has heretofore been the case.

It is also an object of this invention to provide an improved rolling mill for light-section rolled stock, small cross section structural shapes and wire or rod whereby drawbacks of earlier milled systems are avoided.

SUMMARY OF THE INVENTION

These objects are attained, in accordance with the invention by providing a multifunctional path between a conventional intermediate rolling block or unit and a dimensioning finishing rolling block or unit followed by a standard cooling and/or temperature equalization line and, in particular, by forming that multifunctional or multipath section in a particular manner.

More specifically, the object can be achieved with a continuous light-section or wire rod rolling train comprising at least one intermediate rolling unit, a dimensioning finishing rolling unit, a cooling section following the dimensioning finishing unit, a temperature equalization section following the cooling section, and a multi-functional variable path section between the intermediate rolling unit and the dimensioning finishing rolling unit, the multi-functional variable path section comprising three substantially parallel processing lines including:

- a first line connected to an output side of the at least one intermediate rolling unit and including in succession an intermediate rolling block, a first distributing guide, at least one cooling section or temperature equalization section and a second distributing guide having one outlet delivering workpieces to the dimensioning finishing rolling unit;
- a second line having at least one intermediate rolling block and delivering workpieces to the second distributing guide; and
- a third line connected to another outlet of the second distributing guide and provided with at least one cooling section, the rolling train further comprising:

- a first 180°-loop-forming path segment connecting an outlet of the first distributing guide to the third line;
- a third distributing guide connected to the first 180°-loop-forming path segment in the third line and a fourth distributing guide connected to the third distributing guide in the third line;
- a second loop-forming path segment connected between the other outlet of the second distributing guide and the third line;
- a third 180°0-loop-forming path segment connected between one outlet of the fourth distributing guide and the second line between the intermediate rolling block and the cooling section thereof; and
- a fourth 180°-loop-forming path segment connected between the third line and the second line upstream of the intermediate rolling block thereof whereby the workpieces are selectively directable from the first line to the dimensioning finishing rolling unit without traveling over the second and third lines and to the dimensioning finishing rolling unit after traveling over all or part of the second and third lines.

Thus the rolling train downstream of the at least one intermediate rolling unit has three distinct lines of which the first is provided upstream of the rolled product collecting device, usually located at or immediately upstream of the dimensioning finishing rolling unit, with a distributing guide which is capable of accepting rolled product form the second line and delivering rolled product to the third line.

Upstream of that three-way distributor, the first line can include a first intermediate rolling block and, downstream thereof, another distributing guide capable of sending the rolled product to the third line at an intermediate location along the length thereof via a 180° loop forming segment or to cooling temperature equalization sections leading to the three-way distributing guide. The latter can have another loop forming segment connecting an outlet of that guide with the third line upstream of a cooling section and the further distributing guides thereof which selectively transmit the rolled product either through a loop to the second line or further along the third line where, via a 180° loop-forming section, it meets the first line at the upstream end thereof.

With this combination of the three arm distributor and other distributing guides and loop forming (preferably 180°) path segments, the invention can ensure travel of the rolled product via the first line from the intermediate rolling block thereof through the cooling section and temperature equalization section thereof directly to the product collector or the dimensioning finishing rolling unit or past the cooling and temperature equalization sections of the first line to the third line and from there through all or part of the second line which can have a further intermediate rolling block and one or more cooling sections to the dimensioning finishing rolling block and the rolled product collector.

Via the three arm distributor, the rolled product can be delivered to the third line to the second line downstream of its intermediate rolling block.

As a result of the versatility, wire rod thicknesses of 5.0 and 11.0 as well as 11.0 to 22.0 mm can be rolled with intensive cooling, excellent temperature equalization and low inlet, outlet and finishing rolling temperatures in the intermediate rolling blocks and the dimensioning finishing block while the cooling can be reduced. It is also possible to operate as desired with higher inlet and finishing temperatures for those products which can benefit from it.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
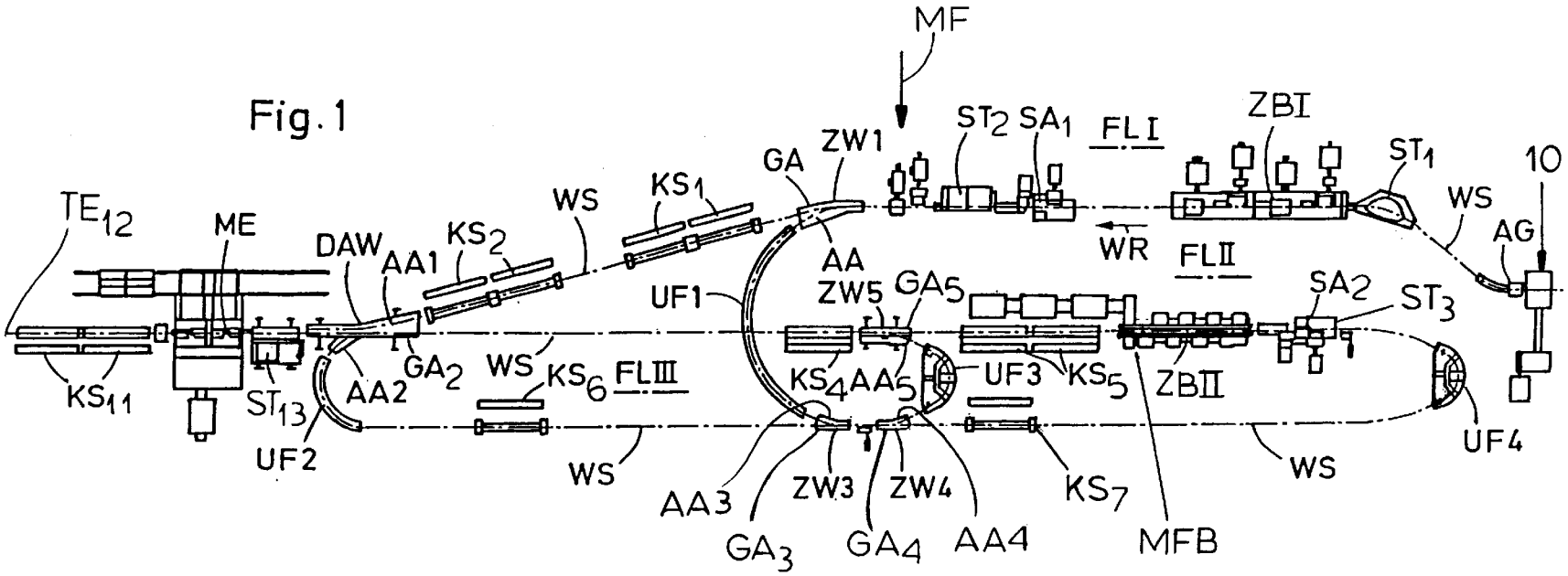
FIG. 1 is a diagram illustrating a portion of a light-section and wire rolling mill train according to the invention.

As can be seen from FIG. 1, the continuous light-section or wire rolling train comprises three parallel lines FLI, FLII and FLIII connected between the output AG of an intermediate rolling unit 10 of a wire rod rolling mill train and the dimensioning finishing rolling unit ME located upstream of a cooling section $KS_{11}$ and downstream of which a temperature equalization stretch $TE_{12}$ is provided.

The system can include a looping table $ST_{13}$ which forms a product collector at the downstream side of the multifunctional path section MF provided with the lines FLI, FLII and FLIII.

The first line FLI has at its upstream side an intermediate rolling block ZBI which can be preceded by a looping table $ST_1$ and is supplied with the workpieces WS from the outlet AG of the intermediate rolling unit of the basic wire rolling line. The structure illustrated at ZBI may represent any number of intermediate mill stands, e.g. two or more.

Downstream of the intermediate rolling block ZBI is a shear SA1 which is followed by a looping table $ST_2$ and that looping table is followed in turn by a branching guide ZW1 with a straight arm GA, and a deflecting arm AA. The straight arm GA can deliver the rolled product to a succession of cooling segments $KS_1$ and $KS_2$ which can also represent temperature equalization sections. At its downstream end, the line FLI opens into a deflecting arm AA1 of a three arm distributing guide DAW which also has a straight arm GA2 and a further deflecting arm AA2. The three arm branching guide DAW has also been referred to herein as the second distributing guide and via the straight arm GA2 the rolled product can be delivered directly the dimensioning finishing unit ME.

The second line FLII has, at its upstream end, a shear SA2 and a looping table $ST_3$ both located upstream of an intermediate rolling block ZBII which can terminate, if desired, in a finishing block or dimensioning rolling block MFB, if desired downstream of the rolling stages is a cooling section KS5 followed by a fifth branching guide ZW5 with a straight arm GA5 and a deflecting arm AA5.

Downstream of the fifth branching guide $ZW_5$ is a cooling segment $KS_4$ which is here referred to as the fourth cooling segment and may be a temperature equalization section.

The line FLII then opens into the straight arm GA2 of the three arm distributing guide GAW.

The third line FLIII has, in the direction of travel of the workpieces a cooling segment or temperature equalization segment $KS_6$ and then a pair of branching guides ZW3 and ZW4 with straight arms GA3 and GA4, respectively as well as a further cooling or temperature equalization segment $KS_7$.

The first, second and third lines FLI, FLII and FLIII are also connected together by loop-forming path segments. For example, the 180° loop forming path segment UF1 connects the deflecting arm AA of the distributing guide ZW1 to a deflecting arm AA3 of the distributing guide ZW3, thereby passing the workpieces to the downstream portion of the third line and bypassing the cooling segments beyond the first distributing guide ZW1. The workpieces can be delivered from the first cooling line and the deflecting arm AA2 of the three arm distributing guide DAW to a second loop-forming segment UF2 at the upstream end of the third line FLIII.

A third 180° loop-forming path segment UF3 delivers the rolled product to the fifth distributing guide ZW5 from the deflecting arm of the distributing guide ZW4.

Finally, a fourth 180° distributing guide is provided at UF4 between the end of the third line and the upstream end of the second line.

Figure 2:
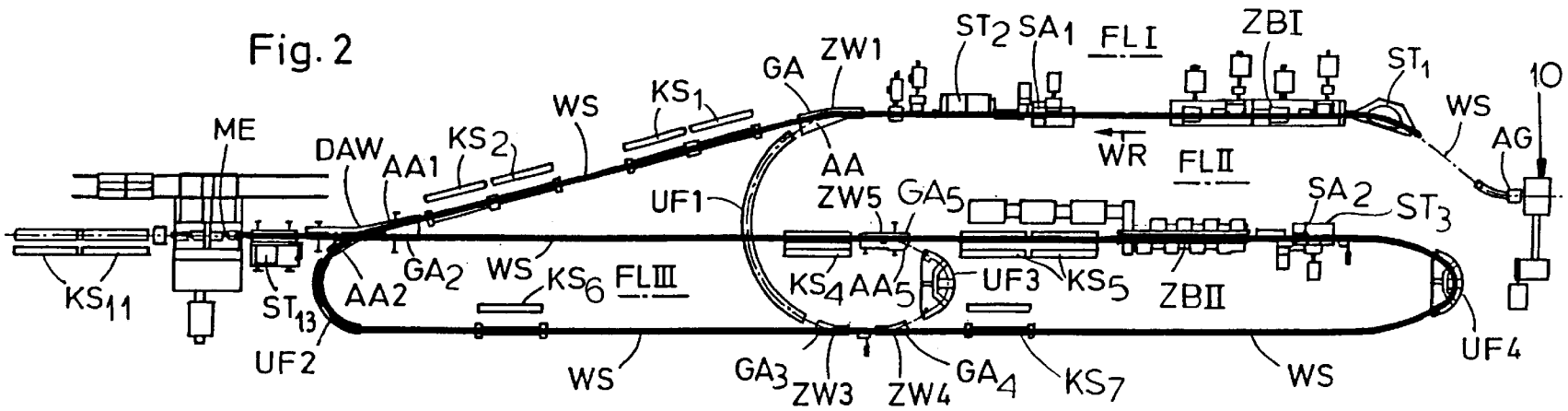
FIGS. 2–5 are views similar to FIG. 1 showing that train in various phases of operation in accordance with the principles of the invention.

FIGS. 2–5 show various configurations of the path of the workpieces or rolled product WS utilizing the aforementioned lines FLI, FLII and FLIII for various purposes. In the pattern of FIG. 2, the workpieces WS are fed through the line FLI and after milling in the intermediate block ZBI and passage through the straight arm GA of the distributing guide ZW1, travel through the cooling sections KS2 and KS2 are directed by the three arm distributing guide DAW via its deflecting arm AA2 to the loop-forming path segment unit UF2. In the latter, the rolled product is reversed in direction and delivered to the upstream end of the third line FLIII and after passage through the cooling segment $KS_6$ and the straight arms GA3 and GA4 of the distributing guides ZW3 and ZW4 are delivered to the cooling segment $KS_7$ and then to the loop forming path segment UF4 to the upstream end of the second line FLII. The workpieces then are passed through the intermediate block ZBII and after travelling through the associated cooling section KS5 can pass via the straight arm GA5 of the fifth distributing guide ZW5, the cooling section $KS_4$ and the straight arm GA2 of the three arm distributing guide DAW to the dimensioning finishing unit ME3.

Figure 3:
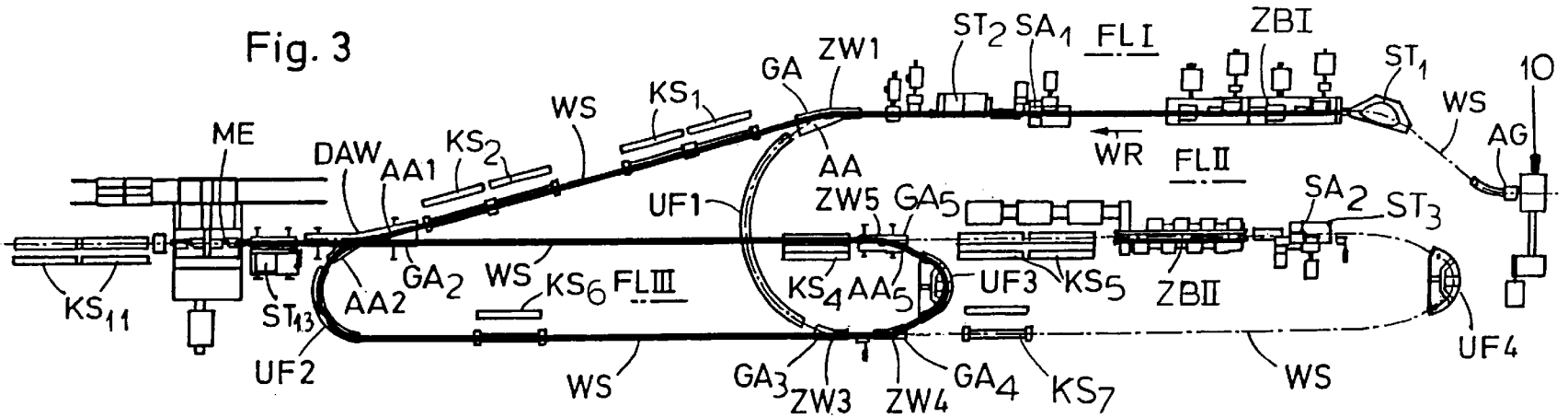
Figure 4:
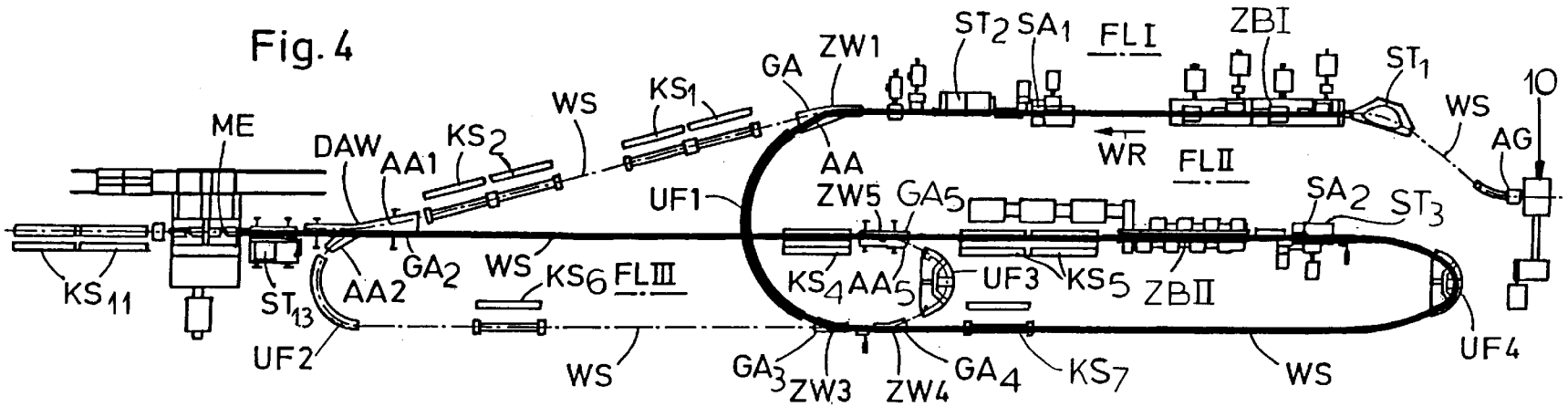

In the embodiment of FIG. 3, the workpieces WS follow the same path as in FIG. 2 up to the fourth distributing guide ZW4 but there are directed to the loop forming path segment UF3 and the deflecting arm AA5 of the fifth distributing guide ZW5 onto the second line FLII downstream of the intermediate roll block ZBII to pass via the cooling section KS4 to the straight arm $GA_2$ of the three arm distributing guide DAW and to the dimensioning finishing rolling unit ME as was described in connection with FIG. 2. In the embodiment of FIG. 4, the workpieces are deflected downstream of the intermediate rolling block ZBI by the first distributing guide ZW1 and the first loop forming segment UF1 to the distributing guide ZW3 and then passes via the straight arm GA4 of the distributing guide ZW4 to the fourth loop forming segment UF4 from which the workpieces travel along the second line FLII in the manner described in connection with FIG. 2.

Figure 5:
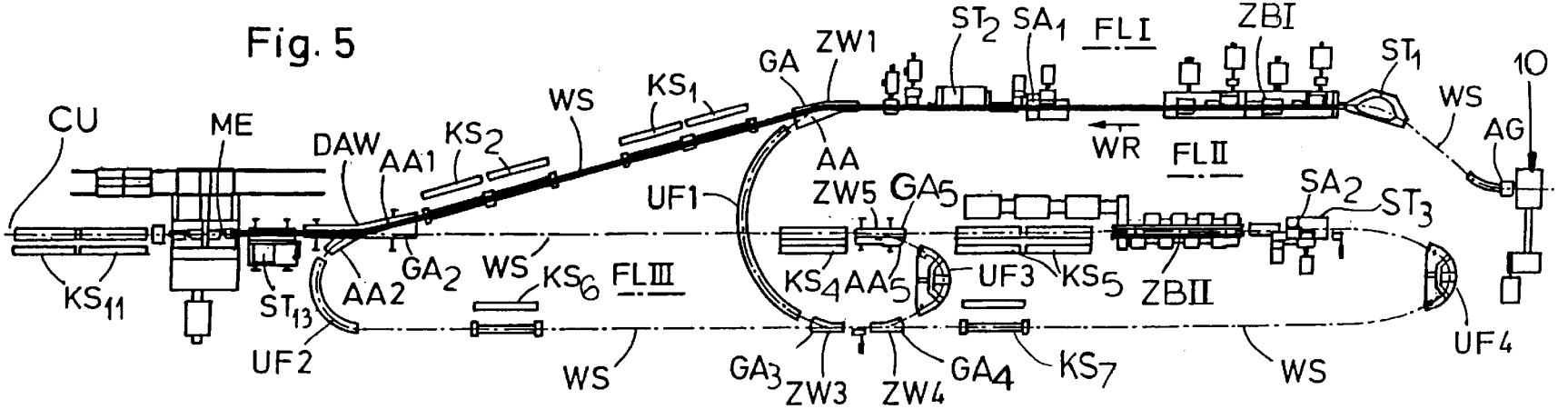

In FIG. 5 we have shown the direct passage from line FLI of the workpieces through the three arm distributing guide DAW to the dimensioning finishing rolling unit ME and any collecting unit CU which may be located downstream thereof or may be associated therewith.

Since the rolled product temperature can be 1050° to 1100° C. upon leaving the intermediate roll unit 10, the cooling sections shown can serve to effect the cooling by at least about 750° C. Relatively long temperature equalization stretches downstream of or between the cooling sections as shown serve to allow effective temperature equalization between core and surface regions of the rolled product and thus permit the dimensioning finishing rolling to be effected at practically uniform temperatures throughout the cross section at a relatively low product temperature and without significant need for compensation for temperature variations.

We claim:

1. A continuous light-section or wire rod rolling train comprising at least one intermediate rolling unit, a dimensioning finishing rolling unit, a cooling section following said dimensioning finishing unit, a temperature equalization section following said cooling section, and a multi-functional variable path section between said intermediate rolling unit and said dimensioning finishing rolling unit, said multi-functional variable path section comprising three substantially parallel processing lines including:

a first line connected to an output side of said at least one intermediate rolling unit and including in succession an intermediate rolling block, a first distributing guide, at least one cooling section or temperature equalization section and a second distributing guide having one outlet delivering workpieces to said dimensioning finishing rolling unit;

a second line having at least one intermediate rolling block and delivering workpieces to said second distributing guide; and a third line connected to another outlet of said second distributing guide and provided with at least one cooling section, said rolling train further comprising:

a first 180°-loop-forming path segment connecting an outlet of said first distributing guide to said third line;

a third distributing guide connected to said first 180°-loop-forming path segment in said third line and a fourth distributing guide connected to said third distributing guide in said third line;

a second loop-forming path segment connected between said other outlet of said second distributing guide and said third line;

a third 180°-loop-forming path segment connected between one outlet of said fourth distributing guide and said second line between the intermediate rolling block and the cooling section thereof; and a fourth 180°-loop-forming path segment connected between said third line and said second line upstream of the intermediate rolling block thereof whereby said workpieces are selectively directable from said first line to said dimensioning finishing rolling unit without traveling over said second and third lines and to said dimensioning finishing rolling unit after traveling over all or part of said second and third lines.

2. The continuous light-section or wire rod rolling train defined in claim 1 wherein said second distributing guide is a three-arm distributing guide having one arm delivering said workpieces directly from said first line to a product collector and another arm for delivering said workpieces from said first line to said third line over a 180° loop formed by said second loop-forming segment.

3. The continuous light-section or wire rod rolling train defined in claim 2 wherein the workpieces from said intermediate rolling unit travel over said first line and the intermediate rolling block and cooling section or temperature equalization section thereof to the three-arm distributing guide and via the second loop-forming path segment to said third line and then via the fourth loop-forming path segment to the second line, the workpieces then passing through the intermediate rolling block and a cooling section or temperature equalization section of said second line to said dimensioning finishing rolling unit.

4. The continuous light-section or wire rod rolling train defined in claim 2 wherein the workpieces from said intermediate rolling unit travel over said first line and the intermediate rolling block and cooling section or temperature equalization section thereof to the three-arm distributing guide and via the second loop-forming path segment to said third line and then via said third loop-forming path segment to said second line through a fifth distributing guide downstream of said intermediate rolling block of said second line.

5. The continuous light-section or wire rod rolling train defined in claim 2 wherein the workpieces from said intermediate rolling unit travel over said first line and the intermediate rolling block thereof to the first distributing guide and then via said first loop-forming path segment to said third line, said workpieces then passing along said third line and via said fourth loop-forming path segment to said second line, and then along said second line through the intermediate rolling block thereof to said dimensioning finishing rolling unit.

6. The continuous light-section or wire rod rolling train defined in claim 5 wherein said second line upstream of a fifth distributing guide connected to said third loop-forming path segment and downstream of the intermediate rolling block of said second line has a finishing or dimensioning rolling block, a further cooling section or temperature equalization section being provided downstream of said fifth distributing guide.

7. The continuous light-section or wire rod rolling train defined in claim 2 wherein the workpieces from said intermediate rolling unit travel over said first line and the intermediate rolling block and cooling section or temperature equalization section thereof to the three-arm distributing guide and then directly to said dimensioning finishing rolling unit and a product collector.

8. The continuous light-section or wire rod rolling train defined in claim 2 wherein said first line comprises upstream of said intermediate rolling block thereof, a looping table for said workpieces, and between said intermediate rolling block of said first line and said first distributing guide, a shear and another looping table, said second line having upstream of said intermediate rolling block thereof and a shear and a looping table and downstream of said intermediate rolling block of said second line, a fifth distributing guide receiving workpieces from said third loop-forming path segment and upstream and downstream of said fifth distributing guide, respective cooling stretches or temperature-equalization sections, said third line comprising respective cooling sections or temperature equalization sections on both sides of said third and fourth distributing guides.

9. The continuous light-section or wire rod rolling train defined in claim 8 further comprising a dimensioning and finishing rolling block in said second line downstream of the intermediate rolling block of said second line.

10. A method of operating a continuous light-section or wire rod rolling train comprising at least one intermediate rolling unit, a dimensioning finishing rolling unit, a cooling section following said dimensioning finishing rolling unit and a temperature equalization section following said cooling section, said method comprising passing workpieces from said intermediate rolling unit through a multifunctional variable path between said intermediate rolling unit and said dimensioning and finishing rolling unit and comprised of three substantially parallel processing lines including a first line connected to an output side of at least one intermediate rolling unit and including in succession an intermediate rolling block, a first distributing guide, at least one cooling section or temperature equalization section and a second distributing guide having an outlet delivering workpieces to said dimensioning finishing rolling unit, a second line having at least one intermediate rolling block and delivering workpieces to said second distributing guide, and a third line connected to another outlet of said second distributing line and having at least one cooling or temperature equalizing section and connected to said second line, and directing said workpieces selectively from said first line to said dimensioning finishing rolling unit without traveling over said second and third lines and to said dimensioning finishing rolling unit after travelling over all or part of said second or third lines.

11. The method defined in claim 10 wherein said workpieces are delivered to said dimensioning finishing rolling unit without travelling over said second and third lines.

12. The method defined in claim 10 wherein said workpieces are directed by said first distributing guide to said third distributing guide through a 180° loop forming path segment and then to said second line through another 180° loop-forming path segment prior to delivery to said dimensioning finishing rolling unit and are subjected along said second line to at least one rolling operation.

13. The method defined in claim 10 wherein said workpieces are directed to said third line by said second distributing guide and a loop-forming path segment and are then delivered to a portion of said second line by another loop-forming segment between being fed to said dimensioning finishing rolling unit, said workpieces being subjected only to cooling or temperature equalization along said second and third lines.

14. The method defined in claim 10 wherein said workpieces are directed to said third line by said second distributing guide and a loop forming path segment, are cooled along a full length of said third line, are directed onto said second line by another loop forming path segment and are subjected to at least one rolling operation along said second line.

* * * * *